US008997388B1

(12) United States Patent
Frost

(10) Patent No.: US 8,997,388 B1
(45) Date of Patent: Apr. 7, 2015

(54) CORRUGATED SIGNAGE

(71) Applicant: Vanguard Packaging, Inc., Kansas City, MO (US)

(72) Inventor: Jerry Ryan Frost, Kansas City, MO (US)

(73) Assignee: Vanguard Packaging, Inc., Kansas City, MO (US)

( * ) Notice: Subject to any disclaimer, the term of this patent is extended or adjusted under 35 U.S.C. 154(b) by 0 days.

(21) Appl. No.: 13/955,811

(22) Filed: Jul. 31, 2013

Related U.S. Application Data

(60) Provisional application No. 61/677,937, filed on Jul. 31, 2012.

(51) Int. Cl.
*G09F 23/00* (2006.01)
*G09F 15/00* (2006.01)
*B31D 5/00* (2006.01)

(52) U.S. Cl.
CPC *G09F 15/00* (2013.01); *B31D 5/00* (2013.01); *G09F 15/0062* (2013.01)

(58) Field of Classification Search
CPC .... G09F 15/0062; G09F 15/0068; G09F 1/06
USPC ..... 40/606.12, 786, 788
See application file for complete search history.

(56) References Cited

U.S. PATENT DOCUMENTS 2,115,293 A * 4/1938 Wood ..... 40/124.18
2,578,060 A 12/1951 Grant
2,918,178 A 12/1959 Leone
3,195,798 A 7/1965 Wilson
3,362,610 A 1/1968 Van Dyke
3,987,737 A 10/1976 Smith
4,143,763 A 3/1979 Haglund
4,306,675 A 12/1981 Swanson
4,341,338 A 7/1982 Arnold
4,383,636 A 5/1983 Chaffers
4,427,108 A 1/1984 Coles et al.
4,458,838 A 7/1984 Lacasa et al.
4,506,790 A 3/1985 Muscari
4,567,996 A 2/1986 Muise
4,646,922 A 3/1987 Smith
4,871,067 A 10/1989 Valenti
4,889,252 A 12/1989 Rockom et al.
4,932,533 A 6/1990 Collier
5,016,545 A 5/1991 Robertson et al.

(Continued)

FOREIGN PATENT DOCUMENTS

CA 2693596 A1 1/2009

*Primary Examiner* — Kristina Junge
(74) *Attorney, Agent, or Firm* — Kutak Rock LLP; Bryan P. Stanley

(57) ABSTRACT

A corrugated display sign with a former panel secured to a backer panel. The former panel includes a central section opposed by two lateral sections, two support members partially cut away from the central section and maintaining a connection with the central section via at least one fold line, and two or more preformed slits, with one slit positioned adjacent to the support members. The display sign further includes a graphic panel operable to be wrapped around exterior edges of the lateral sections, and having ends secured to the backer panel. The display sign is capable of being erected from a knockdown configuration to an erected configuration by folding the lateral sections away from the central section and wrapping the graphic panel about the lateral sections.

19 Claims, 7 Drawing Sheets

(56) References Cited

U.S. PATENT DOCUMENTS

| | | | | |
|---|---|---|---|---|
| 5,145,244 | A | 9/1992 | Kersting et al. | |
| 5,190,211 | A | 3/1993 | Stoddard et al. | |
| 5,193,466 | A | 3/1993 | Eder | |
| 5,213,220 | A | 5/1993 | McBride | |
| 5,226,571 | A | 7/1993 | Eastwood et al. | |
| 5,253,769 | A | 10/1993 | Vlastakis | |
| 5,277,360 | A | 1/1994 | DeMott | |
| 5,301,800 | A | 4/1994 | Kenney | |
| 5,312,034 | A | 5/1994 | Nakagawa et al. | |
| 5,316,210 | A | 5/1994 | Scullin | |
| D348,000 | S | 6/1994 | Strasevicz et al. | |
| 5,318,789 | A | 6/1994 | Nakagawa et al. | |
| 5,322,212 | A | 6/1994 | Strasevicz et al. | |
| 5,333,777 | A | 8/1994 | Roth | |
| D352,235 | S | 11/1994 | Strasevicz et al. | |
| 5,579,991 | A | 12/1996 | Strasevicz et al. | |
| 5,702,011 | A | 12/1997 | Carroll | |
| 5,706,959 | A | 1/1998 | Smith | |
| 5,826,732 | A | 10/1998 | Ragsdale | |
| 5,966,857 | A * | 10/1999 | Pettersson et al. | 40/606.12 |
| 6,068,140 | A | 5/2000 | Mangrum et al. | |
| 6,126,254 | A | 10/2000 | Maglione | |
| 6,168,073 | B1 | 1/2001 | Towle | |
| 6,347,772 | B1 | 2/2002 | L'Hotel | |
| 6,378,710 | B1 | 4/2002 | Grueneberg | |
| 6,508,023 | B2 * | 1/2003 | Moss et al. | 40/610 |
| 6,612,669 | B2 | 9/2003 | Grueneberg | |
| 6,715,623 | B2 | 4/2004 | Broerman | |
| 7,007,615 | B2 | 3/2006 | Grueneberg | |
| 7,066,342 | B2 | 6/2006 | Baechle et al. | |
| 7,111,735 | B2 | 9/2006 | Lowry | |
| 7,137,517 | B2 | 11/2006 | Lowry et al. | |
| 7,252,200 | B1 | 8/2007 | Hester | |
| 7,281,648 | B2 | 10/2007 | Lowry | |
| 7,546,927 | B2 | 6/2009 | Lowry et al. | |
| 7,634,865 | B2 * | 12/2009 | L'Hotel | 40/610 |
| 7,677,433 | B2 | 3/2010 | Little | |
| 7,703,864 | B2 | 4/2010 | Moser | |
| 7,810,707 | B2 | 10/2010 | Little | |
| 7,819,305 | B2 | 10/2010 | Little | |
| 7,861,916 | B2 | 1/2011 | Little | |
| 7,981,017 | B2 | 7/2011 | Little et al. | |
| 8,596,518 | B2 | 12/2013 | Babcock | |
| 2002/0108541 | A1 | 8/2002 | Grueneberg | |
| 2003/0160015 | A1 | 8/2003 | Broerman | |
| 2005/0067321 | A1 | 3/2005 | Pitts et al. | |
| 2008/0030113 | A1 | 2/2008 | Vail | |
| 2008/0083682 | A1 | 4/2008 | Moss et al. | |
| 2008/0169340 | A1 | 7/2008 | Sheffer | |
| 2009/0286663 | A1 | 11/2009 | Little | |
| 2010/0083618 | A1 | 4/2010 | Little | |
| 2010/0087304 | A1 | 4/2010 | Little | |
| 2010/0234201 | A1 | 9/2010 | Little et al. | |
| 2010/0236117 | A1 * | 9/2010 | Mestres Armengol et al. | 40/610 |
| 2011/0011922 | A1 | 1/2011 | Little | |
| 2012/0012734 | A1 * | 1/2012 | Tzuo | 248/683 |
| 2013/0213915 | A1 | 8/2013 | Pfeifer et al. | |

* cited by examiner

CORRUGATED SIGNAGE

RELATED APPLICATIONS

This non-provisional patent application claims priority benefit, with regard to all common subject matter, of earlier-filed U.S. Provisional Patent application No. 61/677,937, filed Jul. 31, 2012, and entitled "FACETED CORRUGATED SIGNAGE." The identified earlier-filed provisional patent application is hereby incorporated by reference in its entirety into the present non-provisional application.

FIELD

Embodiments of the present invention relate generally to the field of point of purchase merchandise displays. More particularly, embodiments of the present invention relate to a corrugated, paperboard sign that is manufactured in a fold and glue assembly process and that is traditionally provided to an end user in a collapsed or knockdown configuration for setup.

BACKGROUND

Corrugated signs and containers are often made from pieces of flat paperboard stock material that are die cut into shapes that define various panels. The shapes are folded along predefined lines between the panels with overlapping sides, strips, or panels that are glued, taped or otherwise affixed to another panel to form an enclosed boundary. The panels are folded and/or glued into place to become the walls of the sign or container. The signs and/or containers are traditionally provided to product manufacturers and/or retailers in a collapsed or knockdown configuration for storage, handling and shipping. The manufacturer and/or retailers open the knockdown signs or containers and fold them appropriately to erect the assembled sign or container for display.

The corrugated sign or containers are typically manufactured by feeding flat die cut sheets through a fold-and-glue machine. The fold-and-glue machine applies adhesive and folds over select panels so that the panels are in the knockdown configuration. Signs associated with corrugated display containers, as well as corrugated and/or plastic signage in general, are traditionally made from flats pieces of corrugated or plastic material. Such signs are one-dimensional and often relatively unimpressive. Therefore, it would be beneficial to provide a corrugated paperboard signage assembly that is three-dimensional and that transforms quickly and easily from a knockdown to an erected configuration.

SUMMARY

Embodiments of the present invention include a corrugated display sign with a former panel secured to a backer panel. The former panel includes a central section opposed by two lateral sections, two support members partially cut away from the central section and maintaining a connection with the central section fold lines, and two or more preformed slits, with at least one of the slits positioned adjacent to each of the support members. The display sign further includes a graphic panel operable to be wrapped about exterior edges of the lateral sections, and having ends secured to the backer panel.

Embodiments of the present invention further include a method for making a corrugated sign including: forming a backer panel; forming a former panel; joining the former panel with the backer panel; compressing the former panel to create fold lines, such that the former panel presents a central section opposed by two lateral sections; cutting the central section of the former panel to present two support members, with the support members operable to be folded away from the former panel; cutting one or more slits in the lateral sections, with at least one of the slits positioned adjacent to each side of each of the support members; wrapping a graphic panel about exterior edges of the lateral sections; and securing ends of the graphic panel to the backer panel.

Embodiments of the present invention further include a method for erecting a corrugated sign. Steps of the method include providing the corrugated display sign in a knockdown configuration, with the corrugated display sign having: a former panel secured to a backer panel. The former panel includes: a central section opposed by two lateral sections; two support members partially cut away from the central section and maintaining a connection with the central section via fold lines; and two or more preformed slits, with at least one of the slits positioned adjacent to each of the support members. The steps further include: folding the support members away from the central section; folding the lateral sections away from the central section until they abut the support members; wrapping a graphic panel about exterior edges of the lateral sections; and securing ends of the graphic panel to the backer panel.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

BRIEF DESCRIPTION OF THE DRAWING FIGURES

Embodiments of the present invention are described in detail below with reference to the attached drawing figures, wherein.

Figure 1:
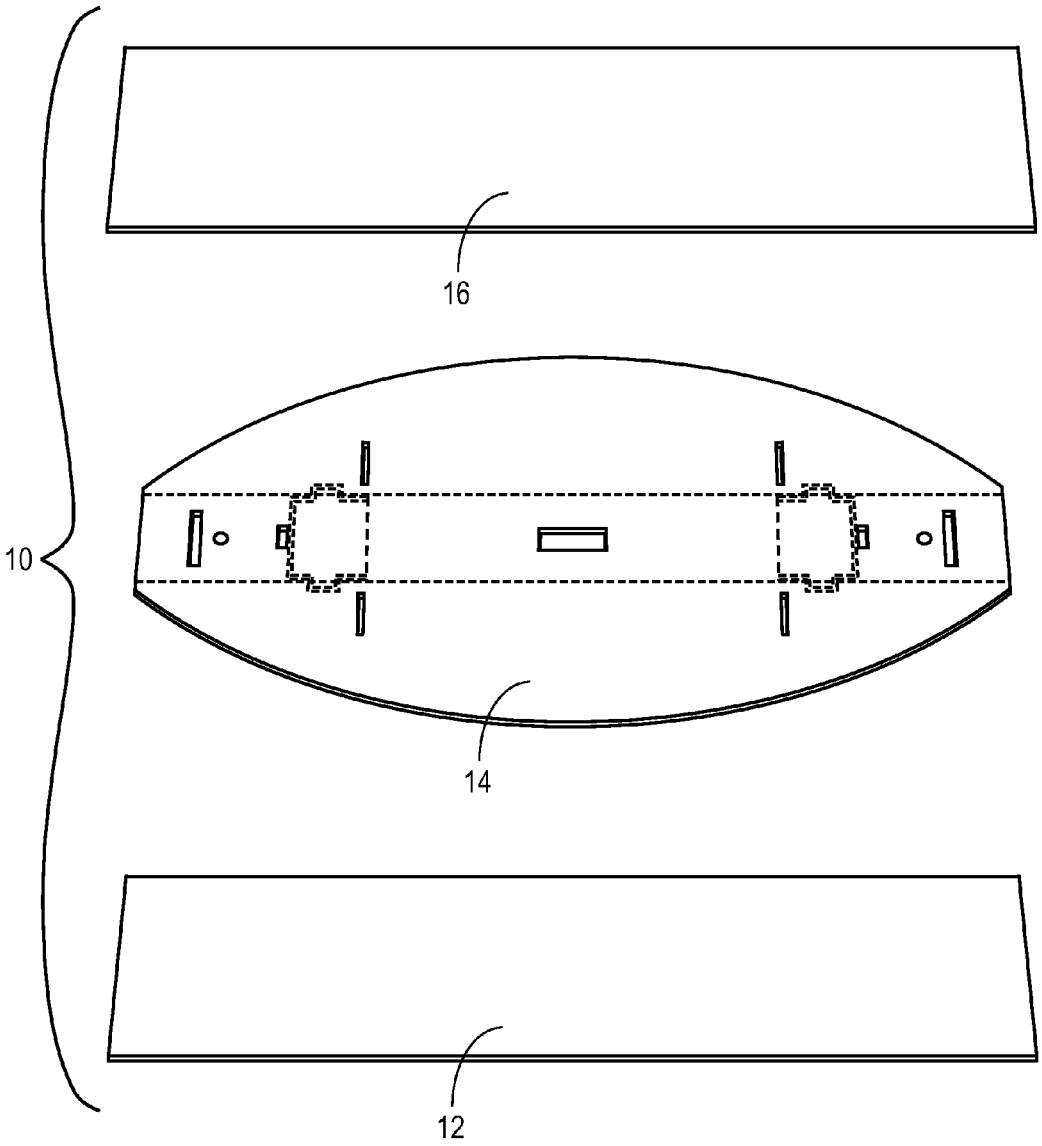
FIG. 1 is an exploded view of a signage assembly of embodiments of the present invention, with the signage assembly including a backer panel, a former panel, and a front graphic panel.

The drawing figures do not limit the present invention to the specific embodiments disclosed and described herein. The drawings are not necessarily to scale, emphasis instead being placed upon clearly illustrating the principles of the invention.

DETAILED DESCRIPTION OF THE EMBODIMENTS

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The following detailed description is, therefore, not to be taken in a limiting sense. The scope of the present invention is defined only by the appended claims, along with the full scope of equivalents to which such claims are entitled.

In this description, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the present technology can include a variety of combinations and/or integrations of the embodiments described herein.

As used herein, the term "longitudinal" generally refers to an orientation or direction relative to an axis of elongation, whereas the term "lateral" refers to an orientation or direction that is generally perpendicular to the axis of elongation.

Figure 2:
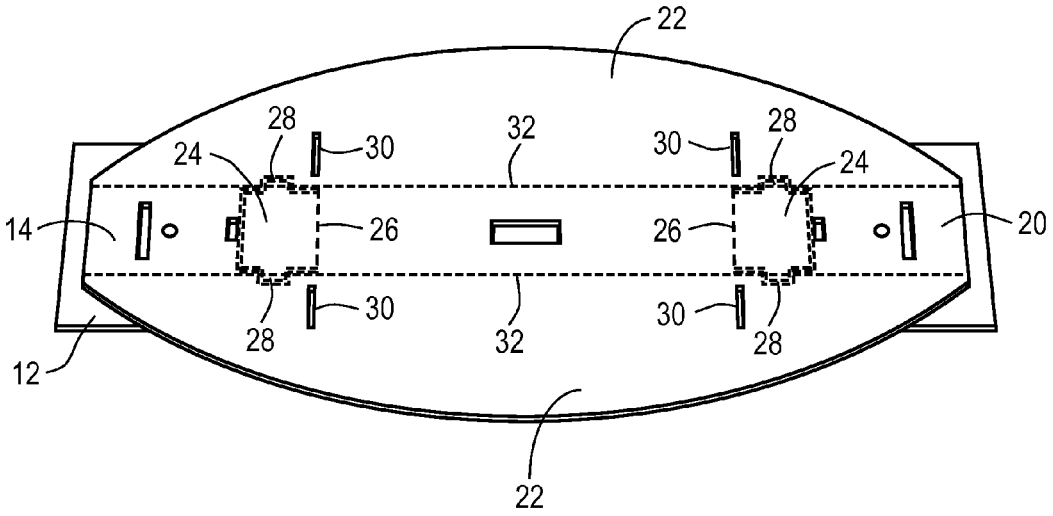
FIG. 2 is a perspective view of the former panel and the backer panel from the signage assembly of FIG. 1 secured together in a knockdown configuration.
Figure 5:
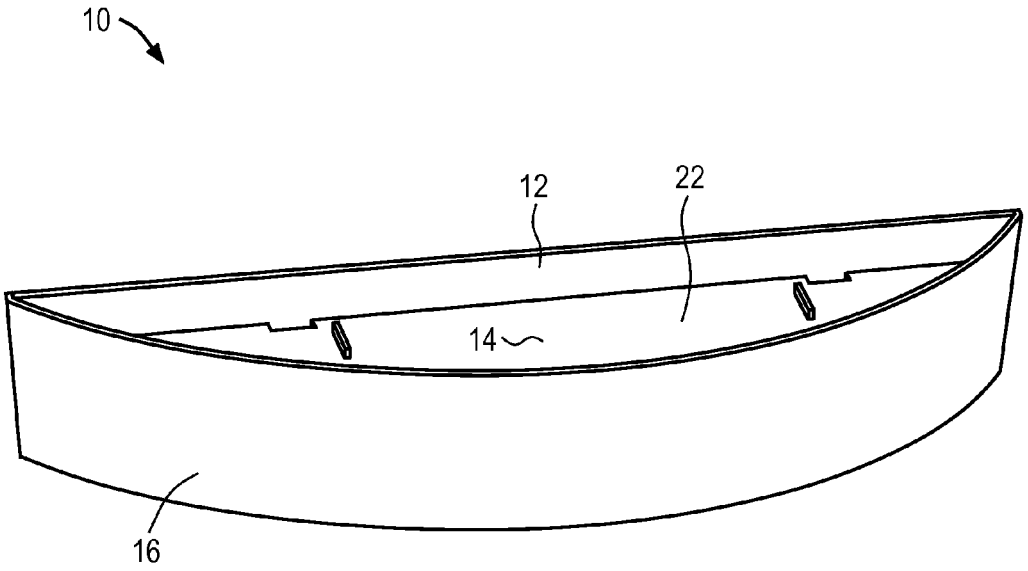
FIG. 5 is a perspective view of the former panel and the backer panel from FIGS. 1-4 in an erected configuration, and with the front graphic panel secured thereto.

Embodiments of the present invention provide a corrugated paperboard signage assembly 10 that is capable of being initially provided in a two-dimensional knockdown configuration, such as illustrated in FIGS. 1-2. From the knockdown configuration, the signage assembly 10 is capable of being erected into a three-dimensional configuration, such as illustrated in FIG. 5. Returning to FIG. 1, the signage assembly of embodiments of the present invention comprises a rectangular backer panel 12; a former panel 14 secured to the backer panel; and a front graphic panel 16 secured to the backer panel and/or former panel. In certain embodiments, each of the back panel 12, former panel 14, and graphic panel 16 are formed from corrugated material. In certain embodiments, such corrugated material includes paperboard. However, other embodiments provide for the corrugated material to include other similar type materials, such as cardboard, fiberboard, or the like.

Turning to FIG. 2, in certain embodiments, the backer panel 12 and the former panel 14 are secured together with an adhesive, such as glue, tape, or other adhesive-like material. Nevertheless, it will be appreciated that other embodiments utilize other means of joining now known or hereinafter developed, including but not necessarily limited to various styles of fasteners, such as staples, rivets, hooks, pins, and the like.

In certain embodiments, the former panel 14 includes a central section 20 opposed by lateral sections 22, with the central section of the former panel being secured to the backer panel 12. In the embodiment shown, the central section 20 includes a longitudinal axis (not shown) of the former panel 14, such that when the former panel is secured to the backer panel 12, the longitudinal axis of the former panel is parallel with or aligned with a longitudinal axis (not shown) of the backer panel. As previously mentioned, the backer panel 12 is generally a rectangular piece of corrugated material. In certain embodiments, ends of the backer panel 12 include slits, notches, or other similar type openings (not shown) formed thereon. As will be described in more detail below, such openings are used to secure the front graphic panel 16 to the backer panel 12.

In embodiments of the present invention, the former panel 14 includes a pair of pre-cut support members 24 that are operable to be folded away from the central section 20 of the former panel. In certain embodiments, the support members 24 are operable to fold along pre-folded, pre-weakened or perforated fold lines 26 connecting the support members to the former panel 14. For example, in some embodiments, the fold lines 26 are formed by compressing along a thin line or a segment of the material comprising the former panel, so as to define the fold line. In certain embodiments, each of the support members 24 includes two tabs 28 that extend laterally from the support members. Additionally, the former panel 14 includes two slits 30 on each of the lateral sections 22, with the slits positioned adjacent to the support members 24. Furthermore, in certain embodiments the lateral sections 22 of the former panel 14 are operable to fold away from the central section 20 of the former panel. As with the support members, certain embodiments provide for the lateral sections 22 to fold about pre-folded, pre-weakened or perforated fold lines 32 that connect the lateral sections to the central section 20 of the former panel 14.

Figure 3:
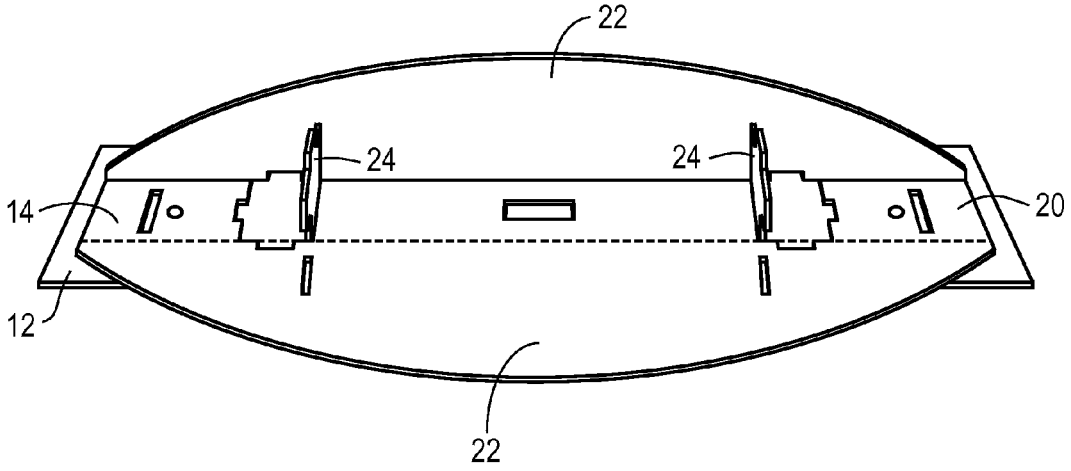
FIG. 3 is a perspective view of the former panel and the backer panel from FIGS. 1-2, with the former panel being partially erected in an erected configuration.
Figure 4:
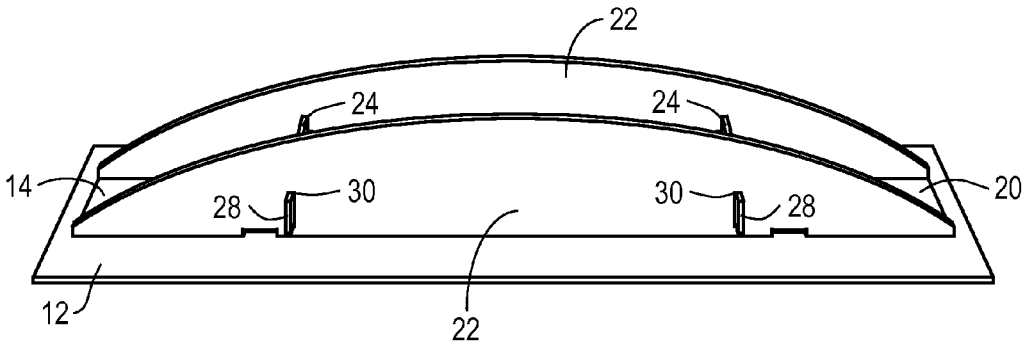
FIG. 4 is a perspective view of the former panel and the backer panel from FIGS. 1-3, with the former panel being fully erected in an erected configuration.

In operation, the signage assembly 10 of the embodiments shown is capable of being transformed in a quick and efficient manner from the knockdown configuration of FIG. 2, to the erected configuration of FIG. 5. To begin, and as illustrated by FIG. 3, the support members 24 of the former panel 14 are folded away from the central section 20 of the former panel until such support members are generally orthogonal to the central section and the backer panel 12. Next, the lateral sections 22 are folded away from the central section 20 until the lateral sections are generally orthogonal to the central section and the backer panel 12. FIG. 3 illustrates a single lateral section 22 folded away from the central section 20, and FIG. 4 illustrates both laterals sections folded away from the central section. As such, and as illustrated by FIG. 4, the slits 30 in the lateral sections 22 mate with the tabs 28 of the support members 24 to provide a rigid and a three dimensional support for the front graphic panel 16.

In the embodiments shown, the front graphic panel 16 is secured to the former panel 14 and/or the backer panel 12 by being wrapped around the lateral sections 22 of the former panel, such as illustrated in FIG. 5. In certain embodiments the front graphic panel 16 is secured to the former panel 14 and/or the backer panel 12 by glue or other adhesive. In other embodiments, the front graphic panel 16 has ends that mate with the openings on the ends of the backer panel 12. For instance, certain embodiments provide for the front graphic panel 16 to have end tabs (not shown) configured to mate with the openings (not shown) at the ends of the backer panel 12 to secure the graphic panel in position. In other embodiments, the ends of the front graphic panel 16 are secured to the ends of the backer panel by other means of securement, such as by hook and loop fastener material, button-hook fasteners, or the like. Thus, as illustrated by FIG. 5, the signage assembly 10 is capable of being erected in the erected configuration that provides for the front graphic display 16 to be presented in a three-dimensional form.

Figure 6:
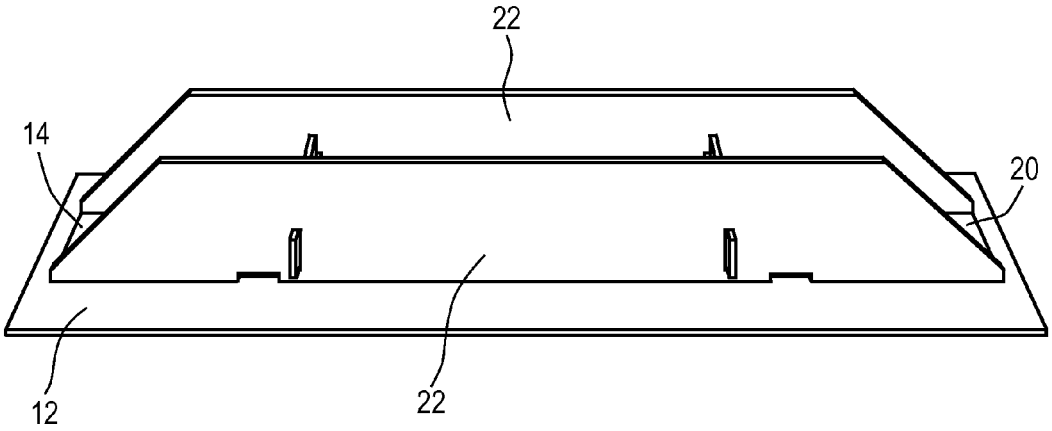
FIG. 6 is an perspective view of a former panel with a segmented shape secured to a backer panel according to embodiments of the present invention.
Figure 7:
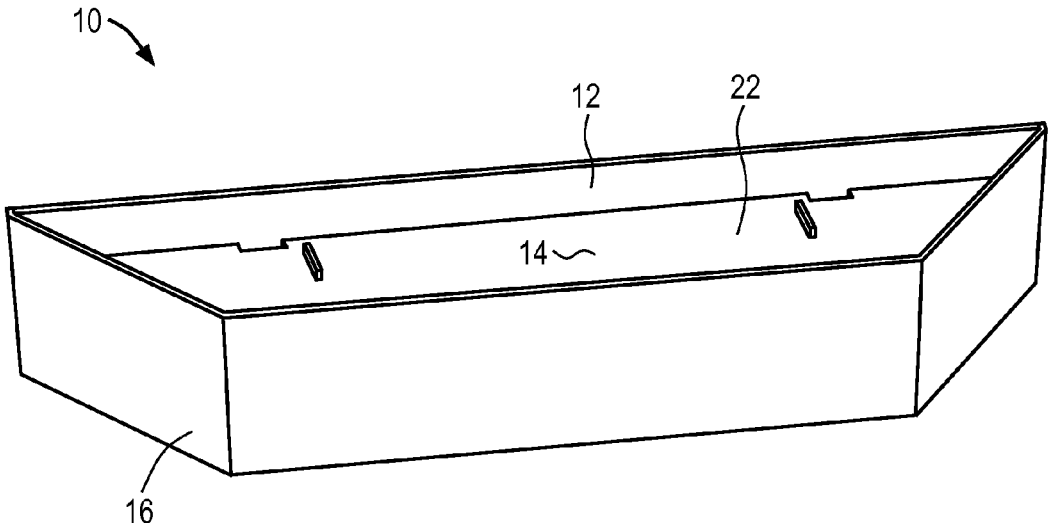
FIG. 7 is a perspective view of the former panel and the backer panel from FIG. 6, with a front graphic panel secured thereto.

In certain embodiments, the front graphic panel 16 is a generally rectangular piece of corrugated material that is sized to fit around the lateral sections 22 of the former panel 14. However, it will be appreciated that the size and shape of the front graphic panel 16 of the will vary in other embodiments without departing from the spirit and scope of the present invention. Furthermore, once the front graphic panel 16 is secured to the former panel 14 and/or the backer panel 12, the presented shape of the front graphic panel is dependent on a shape of exterior edges of the lateral sections. For instance, in embodiments such as shown in FIGS. 1-5, the exterior edges of the lateral sections 22 of the former panel 14 are arcuate in shape, such that when the front graphic panel 16 is wrapped around the lateral sections, the graphic panel is presented in an arcuate three-dimensional configuration (e.g., FIG. 5). Alternatively, as illustrated in FIG. 6-7, embodiments of the present invention include the lateral sections 22 formed with external edges that have one or more linear segments, such that when the front graphic panel 16 is wrapped around the former panel 14, the font graphic panel forms a segmented three-dimensional configuration (e.g., FIG. 7). However, it is understood that embodiments of the present invention include a plurality of types of shapes for the lateral sections 22 of the former panel 14, such that the front graphic panel 16 includes similar corresponding forms and presents a corresponding plurality of three-dimensional shapes.

Although the invention has been described with reference to the embodiments illustrated in the attached drawing figures, it is noted that equivalents may be employed and substitutions made herein without departing from the scope of the invention as recited in the claims.

Having thus described various embodiments of the invention, what is claimed as new and desired to be protected by Letters Patent includes the following:

1. A corrugated display sign comprising:
a backer panel;
a former panel secured to said backer panel, with the former panel including—
a central section,
at least one lateral section coupled to said central section, said lateral section being movable between a stowed position and a deployed position,
two support members partially cut away from said central section and maintaining a connection with said central section via fold lines so as to be movable between a stowed position and a deployed position, and
two or more preformed slits formed in said lateral section, wherein each preformed slit is displaced from said support members when said lateral section is in the stowed position; and
a graphic panel operable to be wrapped about an exterior edge of said lateral section, and having ends secured to said backer panel.

2. The corrugated display sign from claim 1, wherein said display sign is formed from corrugated paperboard material.

3. The corrugated display sign from claim 1, wherein said support members are configured to be moved between the stowed and deployed configurations by being folded about said central section via said fold lines.

4. The corrugated display sign from claim 1, wherein said lateral section is separated from said central section via fold lines.

5. The corrugated display sign from claim 4, wherein said lateral section is configured to be moved between the stowed and deployed configurations by being folded about said central section via said fold lines.

6. The corrugated display sign from claim 5, wherein said lateral section abuts said support members when said lateral section and said support members are in their respective deployed configurations.

7. The corrugated display sign from claim 6, wherein portions of said support members are mated with said preformed slits of said lateral section when said lateral section and said support members are in their respective deployed configurations.

8. The corrugated display sign from claim 7, wherein said support members further include tabs, and wherein said tabs are mated with said preformed slits of said lateral section when said lateral section and said support members are in their respective deployed configurations.

9. The corrugated display sign from claim 1, wherein:
said former panel includes two lateral sections, said lateral sections being coupled to opposed edges of said central section at an interior edge of each of said lateral sections such that an exterior edge of each lateral section is moveable relative to said center section; and
said exterior edges of said lateral sections have an arcuate shape, such that said graphic panel being wrapped about said exterior edges of said lateral sections has a corresponding arcuate shape.

10. The corrugated display sign from claim 1, wherein:
said former panel includes two lateral sections, said lateral sections being coupled to opposed edges of said central section at an interior edge of each of said lateral sections such that an exterior edge of each lateral section is moveable relative to said center section; and
said exterior edges of said lateral sections have a linear segmented shape, such that said graphic panel being wrapped about said exterior edges of said lateral sections has a corresponding linear segmented shape.

11. A method of making a corrugated display sign, comprising:
forming a backer panel;
forming a former panel;
joining said former panel with said backer panel;
compressing said former panel to create fold lines, such that said former panel presents
a central section opposed by two lateral sections via said fold lines;
cutting said central section of said former panel to present two support members, with said support members operable to be folded away from said former panel;
cutting two or more slits in said lateral sections, wherein each slit is displaced from said support members when said lateral sections are in a stowed position;
wrapping a graphic panel about exterior edges of said lateral sections; and
securing ends of said graphic panel to said backer panel.

12. The method of claim 11, wherein said exterior edges of said lateral sections are formed in an arcuate shape, such that with said graphic panel wrapped about said exterior edges, said graphic panel has a corresponding arcuate shape.

13. The method of claim 11, wherein said exterior edges of said lateral sections are formed in a linear segmented shape, such that with said graphic panel wrapped about said exterior edges, said graphic panel has a corresponding linear segmented shape.

14. A method of erecting a corrugated display sign, comprising:
providing said display sign in a knockdown configuration, wherein said display sign includes—
a backer panel;
a former panel secured to said backer panel, with said former panel including:
a central section opposed by two lateral sections, two support members partially cut away from said central section and maintaining a connection with said central section via fold lines, two or more preformed slits, wherein each slit is displaced from said support members when said lateral sections are in a stowed position;

folding said support members away from said central section;

folding said lateral sections away from said central section until said lateral sections abut said support members;

wrapping a graphic panel about exterior edges of said lateral sections; and securing ends of said graphic panel to said backer panel.

15. The method of claim 14, wherein said display sign is formed from corrugated paperboard material.

16. The method of claim 14, further comprising:

mating said support members with said preformed slits of said lateral sections.

17. The method of claim 14, further comprising:

wherein said support members further include tabs, mating said tabs of said support members with said preformed slits of said lateral sections.

18. The corrugated display sign from claim 14, further comprising:

wrapping said graphic panel about said exterior edges, such that said graphic panel presents an arcuate shape.

19. The corrugated display sign from claim 14, further comprising:

wrapping said graphic panel about said exterior edges, such that said graphic panel presents a linear segmented shape.

* * * * *